United States Patent [19]

Kuo

[11] Patent Number: 4,688,275

[45] Date of Patent: Aug. 25, 1987

[54] AUTOMATICALLY-CLOSING STERILIZER FOR TOILET SPRAY ATTACHMENT

[76] Inventor: Dai-Ming Kuo, P.O. Box 10160, Taipei, Taiwan

[21] Appl. No.: 904,029

[22] Filed: Sep. 5, 1986

[51] Int. Cl.[4] ..... A47K 3/22; A47K 3/20; A61H 35/00

[52] U.S. Cl. ..... 4/443; 4/420.4; 4/420.5; 4/447; 4/448

[58] Field of Search ..... 4/443, 420.1–420.5, 4/448, 596, 597, 213; 128/66

[56] References Cited

U.S. PATENT DOCUMENTS

| | | | |
|---|---|---|---|
| 2,826,761 | 3/1958 | Lazarus | 4/448 X |
| 3,808,608 | 5/1974 | Caplan | 4/448 |
| 3,995,326 | 12/1976 | Umann | 4/420.1 X |
| 4,000,742 | 1/1977 | DiGlacomo | 4/448 X |
| 4,087,868 | 5/1978 | Gentz | 4/448 X |
| 4,242,764 | 1/1981 | Fukuda | 4/443 X |
| 4,422,190 | 12/1983 | Huang | 4/443 |
| 4,432,105 | 2/1984 | Pitroda | 4/597 |
| 4,451,942 | 6/1984 | Hirano et al. | 4/443 |

*Primary Examiner*—Henry K. Artis

[57] ABSTRACT

A sterilizer is provided with an automatic closer which includes a resilient plug normally closing a delivery tube of the sterilizer to stop liquid flow from a reservoir filled with cleaning chemical or sterilizing agent to thereby prevent loss of the liquid when not in cleansing user, and which can be opened upon the depression by a user's gravity acting upon a toilet seat to allow the liquid flow for cleansing purpose.

3 Claims, 6 Drawing Figures

AUTOMATICALLY-CLOSING STERILIZER FOR TOILET SPRAY ATTACHMENT

BACKGROUND OF THE INVENTION

U.S. patent application of Ser. No. 787,147 filed Oct. 15, 1985, now abandoned, entitled "Sterilizer for Toilet Spray Attachment" disclosed a sterilizer filled with sterilizing agents or cleaning chemicals which will be automatically directed into a spray nozzle adapted for spraying and cleansing a user's anus or genitals as drawn by a water stream. However, such a sterilizer should require a water stream having a sufficient pressure such as developed by a boosting pump provided on an inlet pipe of a water source, so as to automatically draw the chemical from the sterilizer for flushing. Once the water stream is closed, the chemical liquid is to be held within the liquid tube by the cohesive force of the liquid acting upon the tube wall. If the chemical cleaning liquid has a lower viscosity and tends to gravitationally drain through the liquid tube towards the nozzle opening, it will waste chemical and lose the hygienic effect of the sterilizer.

It is therefore an object of this invention to have a sterilizer system by incorporating an automatic closing device which can serve to automatically close a sterilizer tube, to thereby prevent leakage loss of the cleaning chemical or sterilizing agent when not in use.

SUMMARY OF THE INVENTION

Specifically, the object of the present invention is to provide a sterilizer having an automatic closer which includes a resilient plug normally closing a delivery tube of the sterilizer to stop liquid flow from a reservoir filled with such cleaning chemical or sterilizing agent to thereby prevent loss of the liquid when the sterilizer system is not in use, and which is opened by a user's weight acting upon an associated toilet seat.

DETAILED DESCRIPTION

Figure 1:
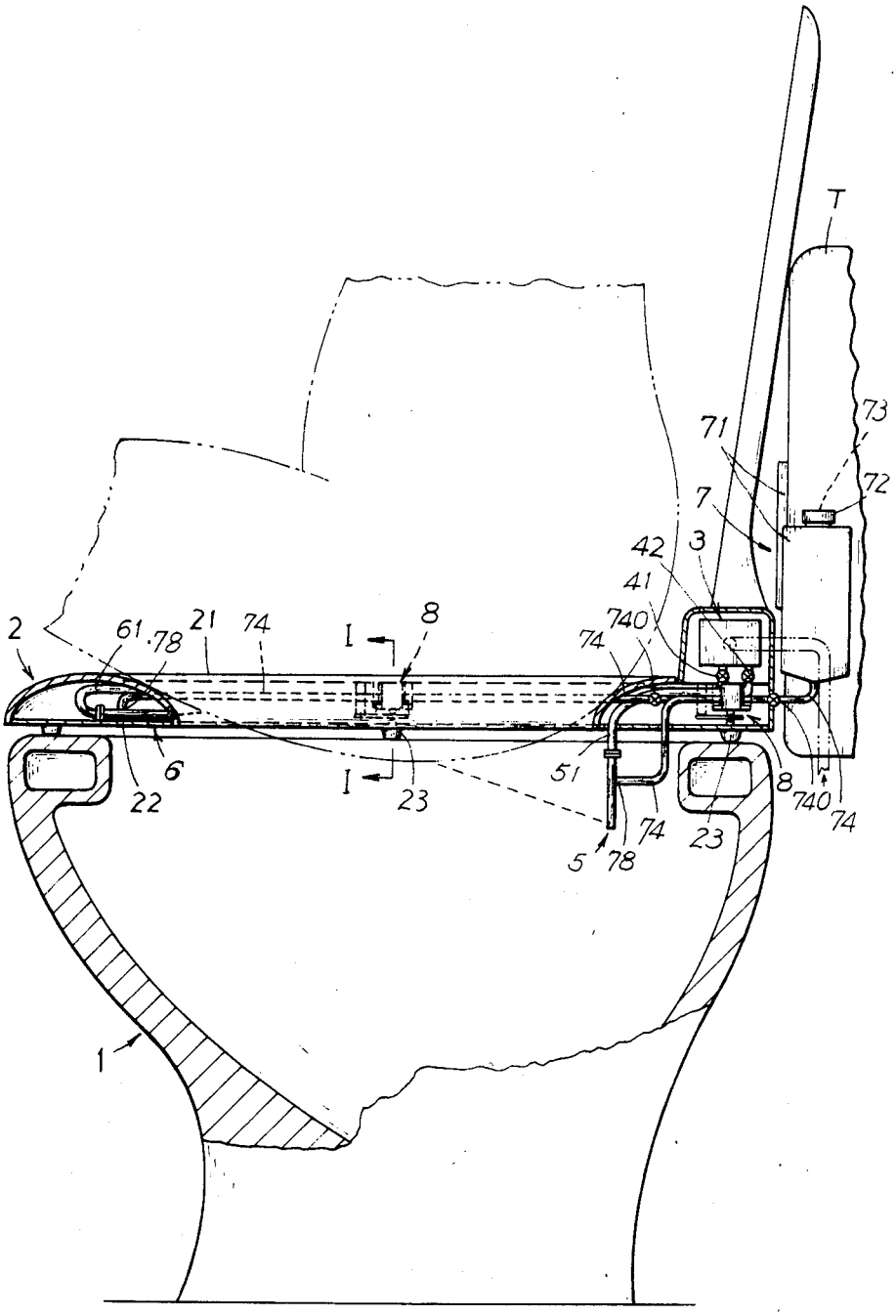
FIG. 1 is a systematic illustration showing the present invention.

As shown in FIGS. 1–5, the present invention comprises: a toilet bowl 1, a toilet seat 2, a warm water soruce 3, a pair of water valves 41, 42 respectively fixed on two water branch conduits 51, 61 communicated with the water source 3, a rear spray nozzle 5, a front spray nozzle 6 and a pair of sterilizers 7.

Each sterilizer 7 includes: a liquid reservoir 71 having a top cover 72 drilled with a venting hole 73 on the cover 72, a delivery tube 74 connected with the reservoir 71 and having its lower port 78 connected with either conduit 51 or 61, and an automatic closer 8 provided on the the delivery tube 74 and positioned in between an upstream tube portion 741 and a downstream tube portion 742 of the tube 74, directed towards either nozzle 5 or 6. Between the reservoir 71 and the automatic closer 8, there is provided a manual valve 740 in each delivery tube 74.

The automatic closer 8 includes a cylindrical body 81 having a flange 814 mounted on socket 211 formed inside an upper seat cover 21 of the toilet seat 2, a resilient plug 82 reciprocatively held within the cylinder body 81, a stem portion 83 extending downwards from the plug 82 a restoring spring 84 inserted within the cylinder body 81 and resiliently retaining the plug 82, a spring plate 85 having its inner end secured to a bracket 212 in the seat 2 and having its outer end contacting the stem portion 83, and an actuating rod 86 extending upwards from an outer end of cushion 23 and normally biasing the cushion 23 downwards to ride on bowl 1 as resiliently acted by the spring plate 85 to thereby float the seat 2 without raising the stem portion 83 for normally closing the plug 82.

Figure 2:
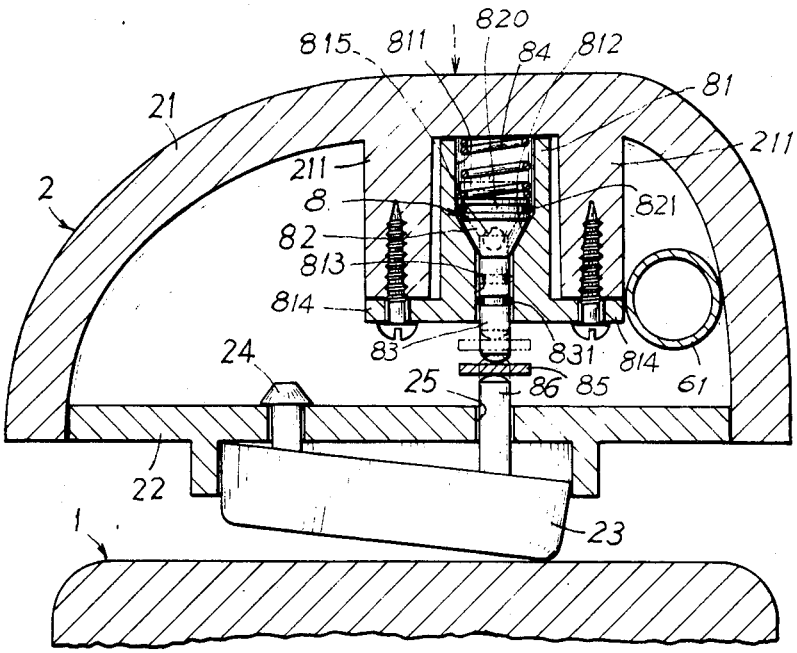
FIG. 2 is a cross-sectional view of the present invention detailing the sterilizer closer mechanism incorporated in the toilet seat.
Figure 3:
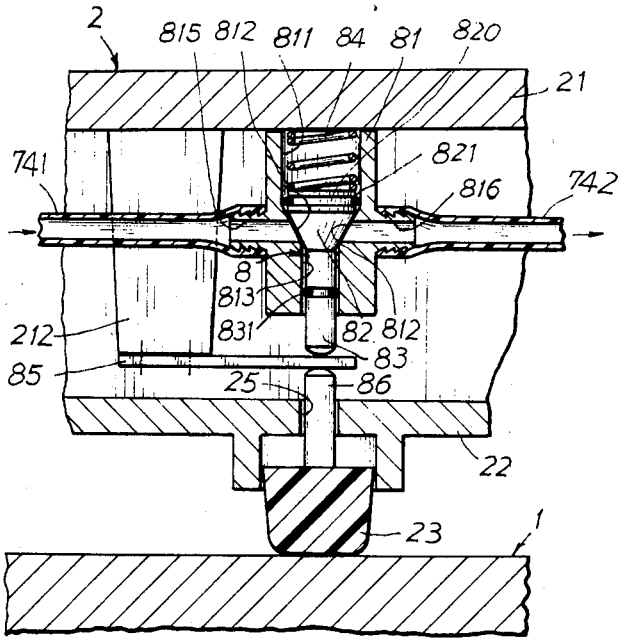
FIG. 3 is a side-view of the present invention as viewed from FIG. 2.

The cushion 23 having formed with such an actuating rod 86 is suitably selected from a plurality of cushions 23 fixed under the lower plate 22 of the toilet seat 2 by modifying one of the two elastic nails 24 mounting the cushion 23 on the plate 22 to be an actuating rod 86 as above-mentioned. The cushion 23 as shown in FIG. 2 is pivoted around the inner elastic nail 24 serving as a "fulcrum" when the outer rod 86 is biased downwards by the spring plate 85.

The cylinder body 81 is formed with an upper cylindrical hole 811 for inserting the spring 84 therein, an inverse truncated-cone hole 812 pertinent and adapted to engage with the plug 82 shaped as an inverse truncated cone under the upper hole 811, a lower cylindrical hole 813 formed under the truncated-cone aperture 812 and having a diameter smaller than that of the upper aperture 811, a liquid inlet aperture 815 is in fluid communication with the upstream tube portion 741 and a liquid outlet aperture 816 is in fluid communication with the downstream tube portion 742. Both holes 815, 816 are in fluid communication with the inverse truncated-cone hole 812 and capable of being sealed by the plug 82 shaped as an inverse truncated cone.

Figure 4:
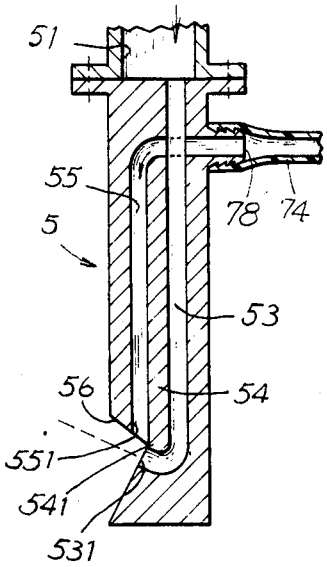
FIG. 4 shows a rear spray nozzle of the present invention.

One delivery tube 74 has its lower port 78 connected with the rear spray nozzle 5 as shown in FIG. 4 in which the rear nozzle 5 includes a water passage 53 in communication with the water conduit 51 and terminated with a water injection hole 531 inclinedly projecting upwardly, a chemical liquid passage 55 communicated with the delivery tube 74 and terminated with a chemical injection opening 551 positioned above the water injection hole 531, a partition plate 54 separating the two passages 53, 55 and a spray cone portion 56 divergently formed from the lower end of the partition plate 54.

Figure 5:
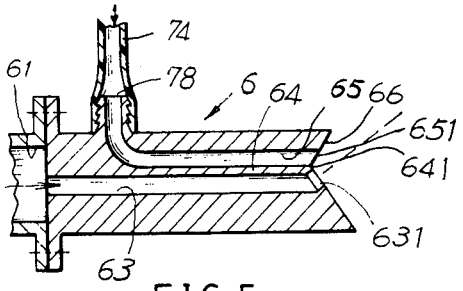
FIG. 5 shows a front spray nozzle of the present invention.

The other delivery tube 74 has its lower portion 78 connected with the front spray nozzle 6 as shown in FIG. 5 in which the front nozzle 6 incldues a water passage 63 communicated with a water injection hole 631 inclinedly projecting upwardly, a chemical liquid passage 65 communicated with the other delivery tube 74 and terminated with a chemical injection opening 651 positioned above the water injection hole 631, a partition plate 64 separating the two passages 63, 65 and a spray cone portion 66 divergently formed from the outer end of the partition plate 64.

When using the present invention, the user's weight on the toilet seat 2 will biase the cushion 23 and its actuating rod 86 upward to raise the stem portion 83 of the plug 82 to open the liquid apertures 815, 816 to initiate the flow of chemical liquid from reservoir 71 towards either nozzle 5 or 6 and whereby upon the opening of valve 41 or 42, the water will be sprayed through either nozzle 5 or 6 to mix with the chemical liquid for hygienic flushing. However when the user leaves the toilet seat, the spring plate 85 will biase the cushion 23 downward to recover the plug 92 which is also restored by the spring 84 to close the liquid apertures 815, 816 to stop liquid drainage.

If the user wants to adjust the liquid quantity or to stop the liquid supply, he or she may close the valve 740 of the chemical tube 74.

As shown in FIGS. 4 and 5, each water injection hole 531 or 631 is located under each liquid opening 551 or 651 and each spray cone portion 56 or 66 is made a trumpet shape so that the liquid drained from the delivery tube 74 will be immediately laden in the water stream as sprayed through either hole 531 or 631 without causing any backflow of water into liquid passage.

Figure 6:
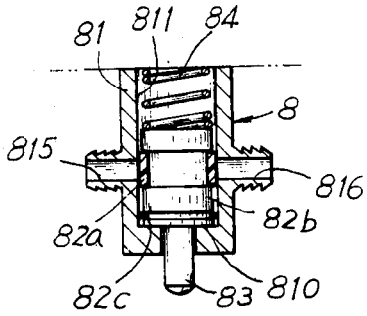
FIG. 6 shows another preferred embodiment of the automatic closer of the present invention.

Another preferred embodiment of the present invention is shown in FIG. 6, in which the aforementioned cylindrical body 81 is formed with a cylindrical hole 811 for inserting the spring 84 and the plug 82. The plug 82 includes a packing plunger 82*a* normally sealing the liquid apertures 815, 816, a rod portion 82*b* is operably afflicted with the plunger 82*a* and has a smaller diameter than that of the plunger 82*a*, a packing ring 82*c* seals the lower portion of the aperture 811 and a stem 83 protrudes downward to contact the spring plate 85. The plug 82 is limited by the cylindrical bottom 810. Upon the depression of toilet seat, the stem 83 will be raised to move the packing plunger 82*a* upward to open the apertures 815, 816 whereby the liquid from the upstream tube 741 will flow through the aperture between the rod portion 82*b* and the cylindrical aperture 811 towards the downstream tube 742 for end use.

I claim:

1. An automatically-closing sterilizer for toilet spray attachment comprising:

a liquid reservoir having a sterilizing agent or cleaning chemical therein and having a top cover with a venting aperture therein;

a delivery tube having a manual valve formed thereon and connected between said liquid reservoir and a spray nozzle which is adapted for either spraying a user's anus or genitals as fluidly communicated with a water source and said tube; and an automatic closer connected between an upstream tube portion and a downstream tube portion of said delivery tube, which includes:

a cylindrical body mounted in a toilet seat and formed with an upper cylindrical aperture, an inverse truncated-cone shaped aperture, and a lower cylindrical aperture; a resilient plug having a truncated-cone shape and matingly engaged with said truncated-cone aperture and retained by a restoring spring in said upper aperture and normally sealing a liquid inlet aperture and a liquid outlet aperture, respectively disposed on both sides of said truncated-cone shaped aperture and fluidly communicated with said tube, a stem portion having smaller diameter than said plug and extending downward from said plug through said lower aperture, a spring plate secured to said toilet seat and contacting said stem portion, and a cushion pivoted under said seat and having its outer end formed with an actuating rod extending upward to be biased by said spring plate to ride said cushion on a toilet bowl so as to float said toilet seat to allow said plug normally sealing said liquid apertures of said liquid delivery tube, and whereby upon depression of said toilet seat by the user's weight, the actuating rod of said cushion will be biased to raise said plug to open said liquid aperture for liquid suction.

2. A sterilizer according to claim 1, wherein said automatic closer includes a cylindrical body having a cylindrical aperture with a plug having a packing plunger normally sealing said liquid apertures, a rod portion having a smaller diameter than said above-located packing plunger, a lower packing ring sealing the lower portion of said cylindrical aperture and a stem protruding downward to contact said spring plate, whereby upon depression of said toilet seat, said stem will be raised to open said liquid apertures for liquid flow.

3. A sterilizer according to claim 1, wherein said spray nozzle includes a water passage in communication with a source of water and having a water injection nozzle projecting upward in the direction of the opening of the associated toilet seat; a liquid passage having a liquid opening positioned above said water injection nozzle, and a spray cone portion formed divergently from the outer end of a partition plate separating said water and liquid passages.

* * * * *